United States Patent [19]

Tyson, Jr.

[11] Patent Number: 4,974,800

[45] Date of Patent: Dec. 4, 1990

[54] PRESSURE CYLINDER HOLDER

[76] Inventor: Perry T. Tyson, Jr., Route 1 Box 1935, Gray, Ga. 31032

[21] Appl. No.: 381,870

[22] Filed: Jul. 19, 1989

[51] Int. Cl.[5] ..... A47F 5/02

[52] U.S. Cl. ..... 248/143

[58] Field of Search ..... 294/4, 15, 27.1, 31.2, 294/68.26; 222/164, 166; 248/130, 133, 137, 139–143, 231; 269/55; 280/47.12, 47.131; 414/425, 448, 778

[56] References Cited

U.S. PATENT DOCUMENTS

| | | | |
|---|---|---|---|
| 462,410 | 11/1891 | Lewis | 248/143 X |
| 486,484 | 11/1892 | Leggett | 248/143 |
| 1,187,017 | 6/1916 | Snow | 248/143 |
| 1,259,265 | 3/1918 | Morgan | 248/143 |
| 1,716,281 | 6/1929 | Pavey | 248/143 |
| 1,790,319 | 1/1931 | Rall et al. | 248/143 X |
| 1,803,797 | 5/1931 | Gerhardt | 248/133 |
| 1,974,675 | 9/1934 | Hoedl | 248/143 X |
| 2,910,304 | 10/1959 | Caylor | 248/143 X |
| 3,022,995 | 2/1962 | Sorenson et al. | 248/143 X |
| 3,240,407 | 3/1956 | Baak | 294/31.2 X |
| 3,310,270 | 3/1967 | Ciancio | 294/31.2 X |
| 4,187,950 | 2/1980 | Peet | 414/421 |
| 4,458,933 | 7/1984 | Thomas | 294/31.2 |
| 4,754,996 | 7/1988 | Tecca et al. | 294/31.2 X |

FOREIGN PATENT DOCUMENTS

| | | | |
|---|---|---|---|
| 11458 | 1/1929 | Australia | 248/143 |
| 207717 | 2/1960 | Austria | 414/448 |
| 1194127 | 11/1959 | France | 248/143 |
| 250549 | 6/1948 | Switzerland | 248/143 |
| 130917 | 8/1919 | United Kingdom | 248/143 |
| 376029 | 7/1932 | United Kingdom | 248/143 |

*Primary Examiner*—Johnny D. Cherry
*Attorney, Agent, or Firm*—Jerry T. Kearns

[57] ABSTRACT

A pressure cylinder holder is designed for use with pressure cylinders of the type utilized to store pressurized gasses. The holder includes a pair of spaced parallel side rail members which define a cradle dimensioned to support a pressure cylinder. A pair of generally trapezoidal end plates are secured between the side rail members, at opposite ends thereof in spaced parallel relation. Each of the end plates has an arcuate cut out dimensioned to receive a pressure cylinder. A pair of spaced parallel lower frame members are secured to the side rail members by perpendicularly secured end rail members. The lower frame members adjacent a bottom end of the holder each terminate in an arcuate bend to facilitate movement of the holder between horizontal and vertical orientations. An elongated strap terminates in opposite hook ends for engagement with the lower frame members. The strap is dimensioned to extend around a pressure cylinder and includes a toggle clamping linkage for securing the strap in a tensioned condition. A support bar extends outwardly from a bottom end plate, in parallel relation therewith, for engagement with a bottom rim of a pressure cylinder. The holder is intended for use in performing service and maintenance operations on pressure cylinders.

1 Claim, 3 Drawing Sheets

PRESSURE CYLINDER HOLDER

BACKGROUND OF THE INVENTION

1. Field of the Invention

The present invention relates to pressure cylinder holders, and more particularly pertains to a pressure cylinder holder adapted for securing a pressure cylinder of the type utilized to store pressurized gasses, for example propane. These conventional gas cylinders typically include a valving mechanism which must be serviced and replaced from time to time. In order to facilitate this and other maintenance operations on such pressure cylinders, the present inventiOn discloses a holder for securing a wide variety of differently dimensioned pressure cylinders, and for selectively orienting the cylinders in either a vertical or a horizontal position.

2. Description of the Prior Art

Various types of pressure cylinder holders are known in the prior art. A typical example of such a pressure cylinder holder is to be found in U.S. Pat. No. 3,240,407, which issued to R. Boak on Mar. 15, 1956. This patent discloses a carrier and hose rack for acetylene gas tanks for use by plumbers, electricians and mechanics. U.S. Pat. No. 3,310,270, which issued to J. Ciancio on Mar. 21, 1967, discloses a gas cylinder holder including a generally cylindrical clamping band which is secured around a cylinder by a thumb screw type threaded clamp. U.S. Pat. No. 4,187,950, which issued to G. Peet on Feb. 12, 1980, discloses a gas can transporter including a pivotal linkage for dispensing gas from the can. U.S. Pat. No. 4,458,933, which issued to C. Thomas on July 10, 1984, discloses a portable carrier for a pressurized cylinder which includes a flexible strap secured in a tensioned condition by a clamping mechanism. U.S. Pat. No. 4,754,996, which issued to F. Tecca et al on July 5, 1988, discloses a pressure cylinder holder including a pair of flexible straps adapted for engagement around a pressure cylinder.

While the above mentioned devices are directed to pressure cylinder holders, none of these devices disclose a holder suitable for use in performing maintenance operations on pressure cylinders. Additionally, none of the aforesaid devices disclose a pressure cylinder holder having arcuate frame portions for tipping a pressure cylinder between vertical and horizontal orientations. Inasmuch as the art is relatively crowded with respect to these various types of pressure cylinder holders, it can be appreciated that there is a continuing need for and interest in improvements to such pressure cylinder holders, and in this respect, the present invention addresses this need and interest.

SUMMARY OF THE INVENTION

In view of the foregoing disadvantages inherent in the known types of pressure cylinder holders now present in the prior art, the present invention provides an improved pressure cylinder holder. As such, the general purpose of the present invention, which will be described subsequently in greater detail, is to provide a new and improved pressure cylinder holder which has all the advantages of the prior art pressure cylinder holders and none of the disadvantages.

To attain this, representative embodiments of the concepts of the present invention are illustrated in the drawings and make use of a pressure cylinder holder designed for use with pressure cylinders of the type utilized to store pressurized gasses. The holder includes a pair of spaced parallel side rail members which define a cradle dimensioned to support a pressure cylinder. A pair of generally trapezoidal end plates are secured between the side rail members, at opposite ends thereof in spaced parallel relation. Each of the end plates has an arcuate cut out dimensioned to receive a pressure cylinder A pair of spaced parallel lower frame members are secured to the side rail members by perpendicularly secured end rail members. The lower frame members adjacent a bottom end of the holder each terminate in an arcuate bend to facilitate movement of the holder between horizontal and vertical orientations. An elongated strap terminates in opposite hook ends for engagement with the lower frame members. The strap is dimensioned to extend around a pressure cylinder and includes a toggle clamping linkage for securing the strap in a tensioned condition. A support bar extends outwardly from a bottom end plate, in parallel relation therewith, for engagement with a bottom rim of a pressure cylinder. The holder is intended for use in performing service and maintenance operations on pressure cylinders.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved pressure cylinder holder which has all the advantages of the prior art pressure cylinder holders and none of the disadvantages.

It is another object of the present invention to provide a new and improved pressure cylinder holder which may be easily and efficiently manufactured and marketed.

It is a further object of the present invention to provide a new and improved pressure cylinder holder which is of a durable and reliable construction.

An even further object of the present invention is to provide a new and improved pressure cylinder holder which is susceptible of a low cost of manufacture with regard to both materials and labor, and which accordingly is then susceptible of low prices of sale to the consuming public, thereby making such pressure cylinder holders economically available to the buying public.

Still yet another object of the present invention is to provide a new and improved pressure cylinder holder which provides in the apparatuses and methods of the prior art some of the advantages thereof, while simultaneously overcoming some of the disadvantages normally associated therewith.

Still another object of the present invention is to provide a new and improved pressure cylinder holder for securing a pressure cylinder during maintenance operations.

Yet another object of the present invention is to provide a new and improved pressure cylinder holder for conveniently orienting a pressure cylinder between vertical and horizontal orientations.

Even still another object of the present invention is to provide a new and improved pressure cylinder holder including an adjustable securing strap for retaining pressure cylinders of a variety of different dimensions.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
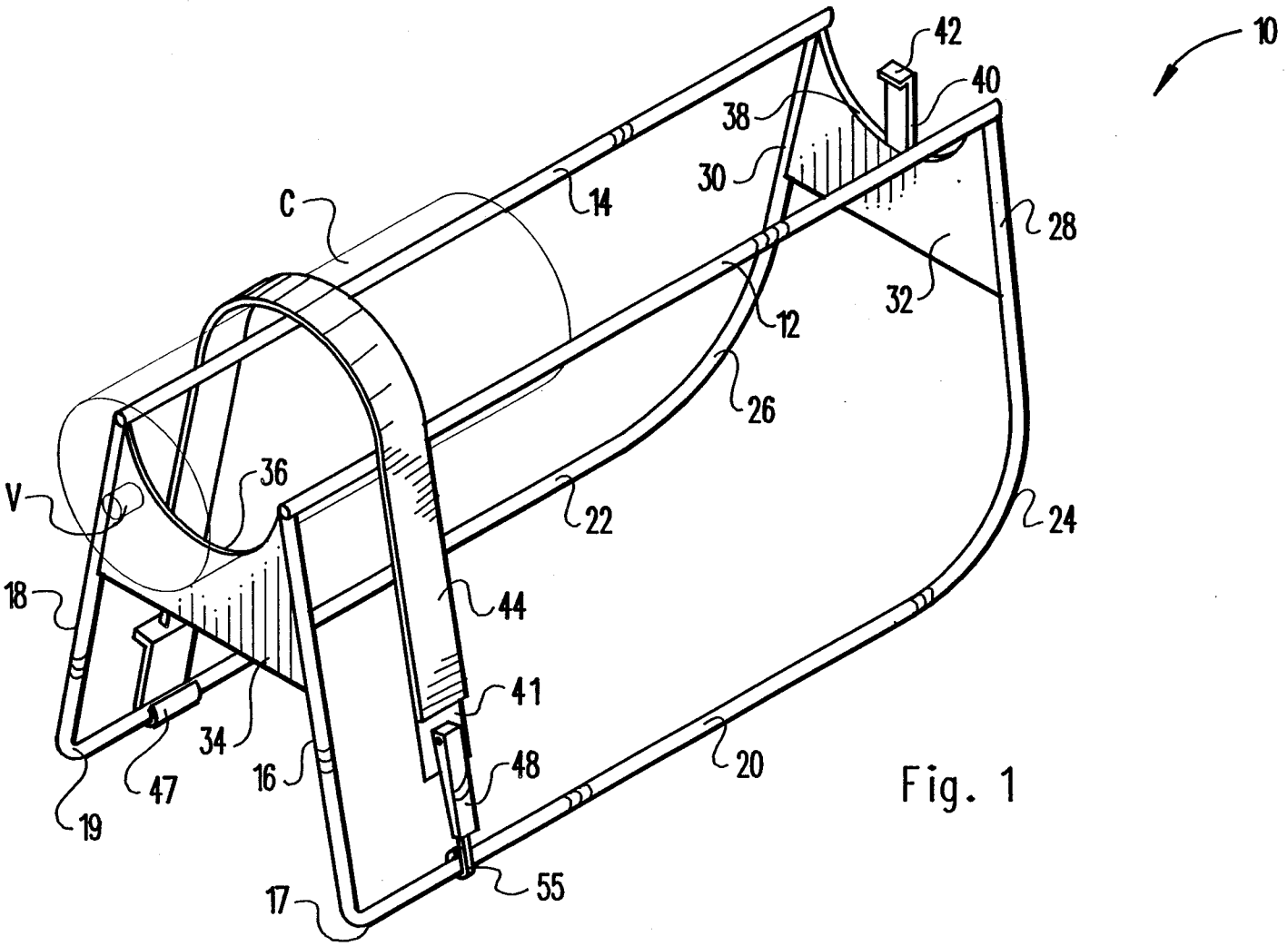
FIG. 1 is a perspective view of the pressure cylinder holder according to the present invention.

With reference now to the drawings, and in particular to FIG. 1 thereof, a new and improved pressure cylinder holder embodying the principles and concepts of the present invention and generally designated by the reference numeral 10 will be described.

More specifically, it will be noted that the first embodiment 10 of the invention includes a pair of spaced parallel side rail members 12 and 14 which define a cradle dimensioned to support a conventional pressure cylinder C. An upper end plate 34 is perpendicularly secured at an upper end of the side rail members 12 and 14, and includes an arcuate cut out 36 for receiving a pressure cylinder. The end plate 34 has a generally trapezoidal shape, with diverging side edges which are secured between upper end rail members 16 and 18. The upper end rail members 16 and 18 are each perpendicularly secured to an upper end portion of one of the side rail members 12 and 14. A pair of 90 degree bends 17 and 19 connect the upper end rail members 16 and 18 to a pair of spaced parallel lower frame members 20 and 22. The lower frame members 20 and 22 are connected by respective arcuate bends 24 and 26 with bottom end rail members 28 and 30. The bottom end rail members 28 and 30 are secured to bottom end of the side rail members 12 and 14. A generally trapezoidal bottom end plate 32 has diverging side edges which are secured to the bottom end rail members 28 and 30. The bottom end plate 32 includes an arcuate cut out 38 dimensioned to receive a pressure cylinder. A supporting bar 40 extends outwardly from the bottom end plate 32, in parallel relation therewith, and includes a right angular flange portion 42 for engagement with a bottom rim of a conventional pressure cylinder. The various components of the holder 10 are preferably formed from a heavy gage steel material, and may be assembled by welding, or through the use of conventional clamps and threaded fasteners. The pressure cylinder C is illustrated in an orientation which allows convenient servicing to the valve V of the cylinder C. A retaining strap 44, is formed from a strong flexible material such as leather, canvass, nylon, etc., and includes opposite hook ends 47 and 55 for engagement with the lower frame members 22 and 20. The hook end 47 is formed on a hook body portion 46 which is adjustably secured to a first end of the retaining strap 44 by a mechanism to be subsequently illustrated and described. The hook member 55 is secured to a hook body portion 48 which may be secured to an elastic member 41 secured to a second end of the retaining strap 44. The elastic member 41 allows the retaining strap 44 to be maintained in a tensioned condition while securing a variety of differently dimensioned pressure cylinders.

Figure 2:
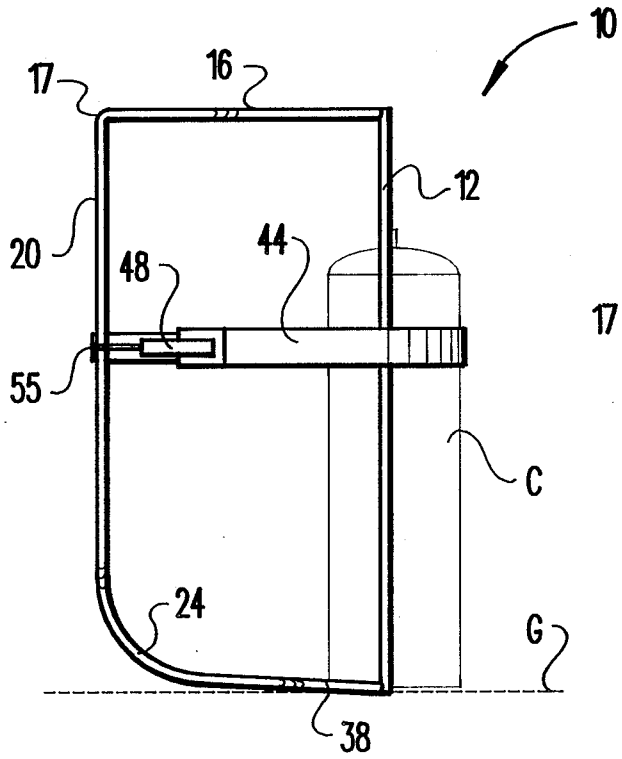
FIG. 2 is a side view illustrating the pressure cylinder holder in a vertical orientation.

FIG. 2 is a side view which illustrates the holder 10 in a vertical orientation. The pressure cylinder C is received between the side rail members 12 and 14 (FIG. 1), with the supporting bar 40, 42 in engagement with the bottom rim of the cylinder C. The retaining strap 44 is then secured around the cylinder C and an individual may utilize the arcuate bend portions 24 and 26 to tip the cylinder C to a horizontal orientation for the performance of maintenance operations. The plane of the surface of the ground or floor is indicated by G.

Figure 3:
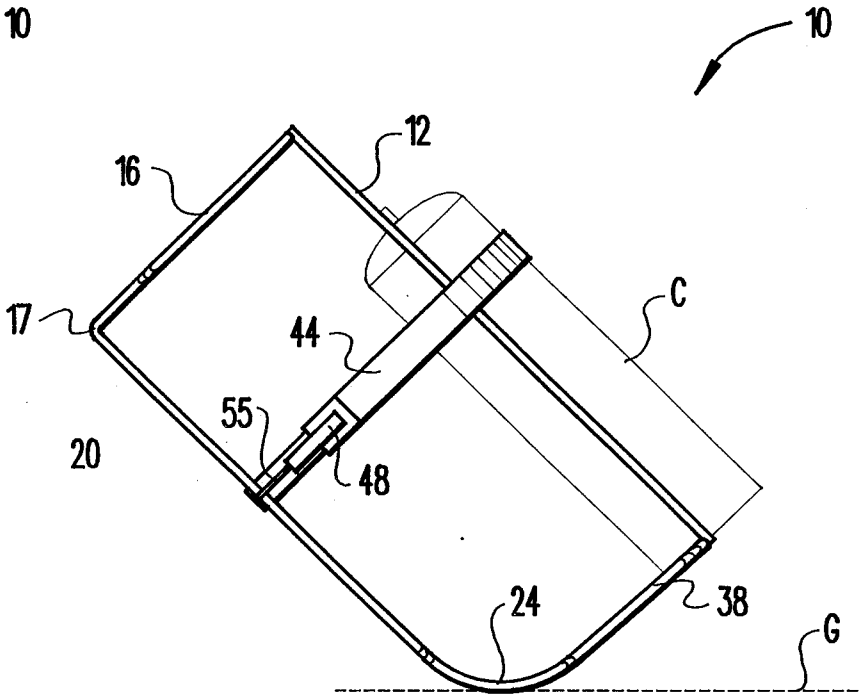
FIG. 3 is a side view illustrating the pressure cylinder holder in the process of being moved to a horizontal orientation.

FIG. 3 illustrates the carrier 10 in the process of being moved to a horizontal orientation.

Figure 4:
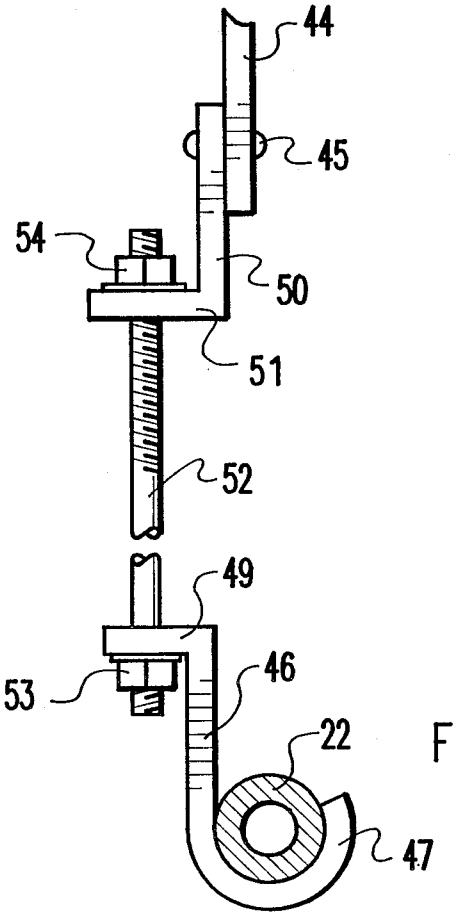
FIG. 4 is a detail view illustrating a mechanism for adjustably securing a hook end on the retaining strap.

FIG. 4 illustrates an adjustable securing mechanism for connecting the hook body portion 46 with the retaining strap 44. A first leg portion 50 of an L-shaped bracket is secured by one or a plurality of rivets 45 to the end of the strap 44. The second leg portion 51 of the bracket includes a circular aperture which receives a threaded stud 52. A flange portion 49 of the hook body member 46 receives an opposite end of the stud 52, which is adjustably secured by nuts 53 and 54. This allows adjustment for accommodation of various different dimensions of pressure cylinders.

Figure 5:
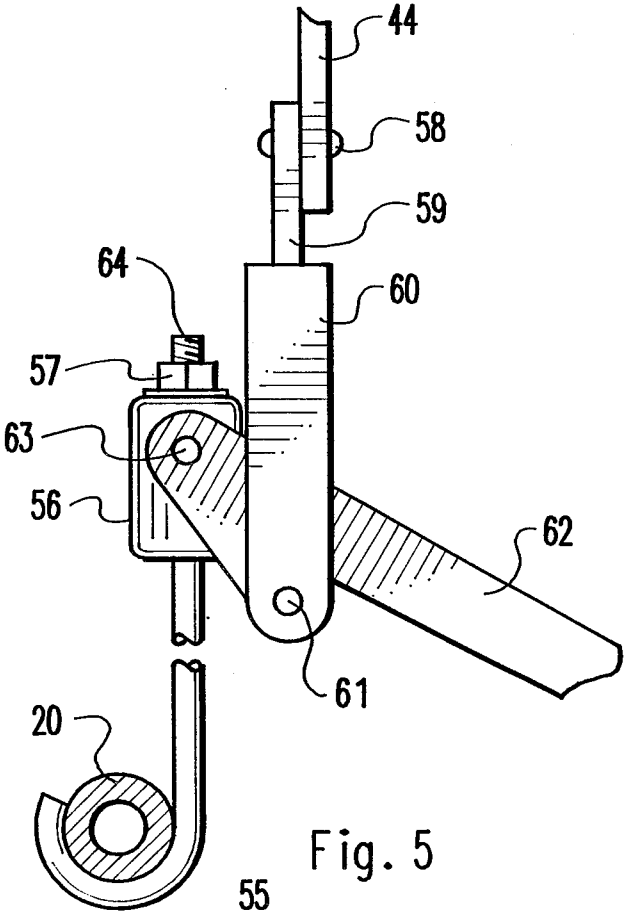
FIG. 5 is a detail view illustrating a toggle linkage clamp for securing the retaining strap in a tensioned condition.

FIG. 5 illustrates an adjustable toggle clamping mechanism which may be utilized as an alternative to the elastic member 41 illustrated in FIG. 1. A block 60 includes a tab portion 59 which is secured by one or a plurality of rivets 58 to an end portion of the retaining strap 44. An elongated handle 62 has a laterally projecting portion secured by a pivot pin 61 to an end portion of the block 60. A distal end portion of the handle 62 is secured by a pivot pin 63 to a hook mounting block 56. An elongated shank 64 of the hook 55 is provided with a threaded end portion which is adjustably secured by a nut 57. The shank 54 is received through a cylindrical bore formed in the block 56. By manipulation of the handle 62, the strap 44 may be secured in a tensioned condition around a pressure cylinder, in the manner of an over center type toggle clamp.

As may now be understood, the present invention provides a pressure cylinder holder which allows a pressure cylinder to be conveniently oriented between vertical and horizontal positions and held securely in place during the performance of various maintenance operations.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

what is claimed as being new and desired to be protected by LETTERS PATENT of the United States is as follows:

1. A pressure cylinder holder, comprising;

a pair of spaced parallel side rail members;

an upper end plate perpendicularly secured at an upper end of said side rail members and having an arcuate cut out for receiving a pressure cylinder;

a pair of upper end rail members each having one end perpendicularly secured to an upper end of one of said side rail members;

a pair of spaced parallel lower frame members each having a first end perpendicularly secured at an opposite end of one of said upper end rail members;

a pair of bottom end rail members;

each of said lower frame members having an opposite end connected by an arcuate bend to one of said bottom end rail members;

said bottom end rail members each secured to a bottom end of one of said side rail members;

a bottom end plate secured between said bottom end rail members and extending in spaced parallel relation with said upper end plate;

said bottom end plate having an arcuate cut out for receiving a pressure cylinder;

said side rail members, said upper end plate and said bottom end plate cooperating to define a cradle dimensioned to support a pressure cylinder;

each of said upper and bottom end plates having a generally trapezoidal configuration with diverging side edges secured between said rail members;

a support bar extending generally parallel with said bottom end plate and secured thereto for supporting a bottom surface of a pressure cylinder;

an elongated strap terminating in opposite hook ends for engagement with said lower frame members, said strap dimensioned to extend around a pressure cylinder supported between said side rail members; and a toggle linkage clamp on said strap for locking said strap in a tensioned condition around a pressure cylinder, said toggle linkage clamp having a tab end portion secured to one end of said strap, a block having one end secured to said tab, and elongated handle having a laterally projecting portion pivotally secured to an end of said block opposite said tab, a hook mounting member pivotally secured to an end of said handle, an elongated shank of one of said hook ends in adjustable threaded engagement with said hook mounting member.

* * * * *